US005418379A

United States Patent [19]

Parsons et al.

[11] Patent Number: 5,418,379

[45] Date of Patent: May 23, 1995

[54] CONNECTOR ASSEMBLY FOR A RADIOGRAPHIC CAMERA

[75] Inventors: George W. Parsons, North Reading; David E. Duncanson, West Newbury, both of Mass.

[73] Assignee: Amersham Corporation, Burlington, Mass.

[21] Appl. No.: 148,283

[22] Filed: Nov. 8, 1993

[51] Int. Cl.[6] ..... G21F 5/02
[52] U.S. Cl. ..... 250/497.1
[58] Field of Search ..... 250/496.1, 497.1

[56] References Cited

U.S. PATENT DOCUMENTS

| | | | |
|---|---|---|---|
| 3,393,317 | 7/1968 | Spencer | 250/497.1 |
| 3,643,096 | 2/1972 | Jeffries et al. | 250/497.1 |
| 3,669,093 | 6/1972 | Sauerwein et al. | 250/497.1 |
| 3,939,355 | 2/1976 | Rosauer | 250/497 |
| 4,211,928 | 7/1980 | Parsons, Jr. et al. | 250/497 |
| 4,225,790 | 9/1980 | Parsons, Jr. et al. | 250/497 |
| 4,281,252 | 7/1981 | Parsons, Jr. et al. | 250/497 |
| 4,827,493 | 5/1989 | Parsons et al. | 378/119 |
| 5,065,033 | 11/1991 | Parsons | 250/497.1 |

OTHER PUBLICATIONS

Nordion International, "Titan: The Light Heavyweight" Materials Evaluation, Mar. 1993 pp. 315–316.

BNEN, "Apparatus For Industrial Gamma Radiography—Design Construction Specification And Tests", Sep. 1992.

*Primary Examiner*—Bruce C. Anderson
*Attorney, Agent, or Firm*—Wolf, Greenfield & Sacks

[57] ABSTRACT

A radiographic camera has a housing which enclosed a tube with a radiographic source. The conduit is coupled to a locking assembly at the back end of the camera and to a connector at the front end of the camera. A plug assembly is coupled in the connector mechanism. The connector has a movable shield which selectively blocks the conduit from the exterior of the housing when the plug assembly is partially removed, and unblocks the conduit when the plug assembly is removed and when a guide cable is being attached. The shield is mounted on a slide which also has a connection to a switch on the back of the camera. The switch is actuable when the shield is not blocking the conduit. The switch allows control cables to be connected to the locking assembly and can be actuated after the guide cable is attached.

32 Claims, 17 Drawing Sheets

CONNECTOR ASSEMBLY FOR A RADIOGRAPHIC CAMERA

FIELD OF THE INVENTION

This invention relates to-a connector assembly for a radiographic camera.

BACKGROUND OF THE INVENTION

An X-ray machine can be used to make photographic images which indicate the internal composition of objects. One well known use is the detection:of broken or fracture bones. A typical X-ray machine is inadequate for some tasks because it is unable to make photographic images of metals. Since a typical X-ray machine is large and requires a power source, it cannot be taken to remote locations without significant expense.

Radiographic cameras are used to make images similar to X-ray images, but with greater flexibility. A radiographic camera can record images of metals which cannot be imaged with an X-ray machine. In addition these cameras are portable and operate without an external power source, and so can take images of objects in their natural environment. Radiographic cameras are used extensively in the oil industry, for example, to check for flaws in metal pipelines which could otherwise cause oil spills.

A typical radiographic camera and source are shown and described in U.S. Pat. Nos. 5,065,033 and 4,827,493, respectively. Each of these patents is assigned to the same assignee as the present invention, and each is hereby incorporated by reference. As shown in FIG. 1 of U.S. Pat. No. 5,065,033, an S-shaped tubing extends from a back end of the camera to a front end. The tubing is surrounded by a radiation shield and encloses a radiographic source at the end of a source cable. A typical radiographic source includes stacked iridium-192 wafers which are welded inside a capsule. Since the radiographic source emits radiation in a line, when the source is in a stored position (as in FIG. 1), only minimal radiation is reflected toward the front end, by which time any power that remains is significantly decreased.

A lock assembly is provided over an opening at the back end of the camera, and a threaded nut blocks an opening at the front end. Control cables are attached to the back end, and a guide cable is screwed to the front end. The lock assembly in the back prevents the radiation source from being pushed out of the front end without first using a key to unlock the camera, and then connecting a control cable. At the front end of a typical camera, a technician removes the threaded nut, and attaches a guide cable with a threaded end over the threaded mount on the housing. When the control cables and guide cable are positioned, the technician operates a hand crank to move a wire in the control cable which pushes the source out of the camera housing and to the end of the guide cable. The end of the guide cable is then positioned on one side of an object which is to be imaged, and photographic cassettes is placed on the other side. Exposure time is set by the technician. When finished, the technician reverses the direction of the crank to retract the source.

SUMMARY OF THE INVENTION

Accordingly to the present invention, the front end of a radiographic camera has a connector assembly mounted to the housing of the camera at a front opening. A plug assembly blocks the front opening when in a stored position. The plug assembly cannot be completely removed from the connector assembly until a shield is first moved to block the opening. After the shield is put into a position where it blocks the opening, the plug assembly is completely removed and a guide cable fitting can be coupled to the camera.

An interlock mechanism is also provided between a lock assembly at the back of the camera and the connector assembly so that a lock assembly cannot be actuated to receive a control cable until the guide cable is coupled to the front end. Consequently, the lock assembly cannot be accessed by the control cables when the plug assembly is removed and the shield is over the opening. Rather, the guide cable must be on, or the plug assembly must be in the connector assembly.

In a preferred embodiment, a camera housing encloses a radiation source which is kept in an S-shaped tubing at an end of a source cable. The source cable is connected at its other end to the lock mechanism similar to the mechanism shown in U.S. Pat. No. 5,065,033.

The plug assembly has a cylindrical plug fitting with a central opening through which a plug wire extends. When the plug assembly is coupled to the camera, one end of the plug wire extends into the tubing and is at or near the source to help prevent it from being dislodged. The plug wire is rigidly coupled at its other end to a threaded plug which is screwed to an outside portion of the plug fitting. The wire can be moved from inside to-outside the tubing without removing the fitting.

A manually actuable slide has the shield and is moved to selectively block and unblock the opening with the shield. When the opening is unblocked, a switch on the back portion of the housing is made actuable. By pushing the switch, a cap over the lock mechanism at the back portion can be opened, thus allowing the control cables to be connected to the camera.

The present invention adds safety features to radiographic cameras. While these cameras are strictly regulated and used by trained technicians, the present invention adds further safety features which are not currently required by United States regulatory agencies. The plug assembly cannot be completely removed until the opening at the plug assembly is shielded. An interlock is provided between the front and the back of the camera so that the control cables cannot be connected unless either the guide cable is connected or the plug assembly is in the front end. These features can help prevent accidents due to even unlikely errors by technicians.

BRIEF DESCRIPTION OF THE DRAWINGS

Other features and advantages will become apparent from the following detailed description and from the drawings in which.

DETAILED DESCRIPTION

The present invention relates to a connector assembly for radiographic camera. A radiographic camera has a housing with openings at a front end and a back end where a guide cable and control cables, respectively, are coupled. A lock assembly is provided at the opening in the back end, and a connector assembly is provided at the opening in the front end. A radiation source is mounted at the end of a source cable which is in a tube which is typically S-shaped. The tube is enclosed inside the housing and is coupled to the lock assembly and to the connector assembly. The source is inside the housing when the camera is in the stored position.

When the camera is to be used, the control cables and guide cable are attached to the lock assembly and the connector assembly, respectively. The control cable has a wire which pushes the source from the camera housing into the guide cable when a technician operates a crank at the end of the control cables. The source is pushed until it reaches the end of the cable. The end of the guide cable would have been placed against an object with photographic film cassettes positioned on the other side of the object. A technician determines exposure time. After that time has lapsed, the technician operates the crank to withdraw the source from the guide cable into the source tube in the housing.

An interlock assembly is provided so that a technician can only couple a guide cable to the front end after the front opening has been shielded. The technician can only attach control cables to the back opening of the camera by pressing a switch which is activated when the guide cable is attached. The lock assembly at the back end controls how the control cables are connected, and is disclosed in the incorporated U.S. Pat. No. 5,065,033.

Figure 3:
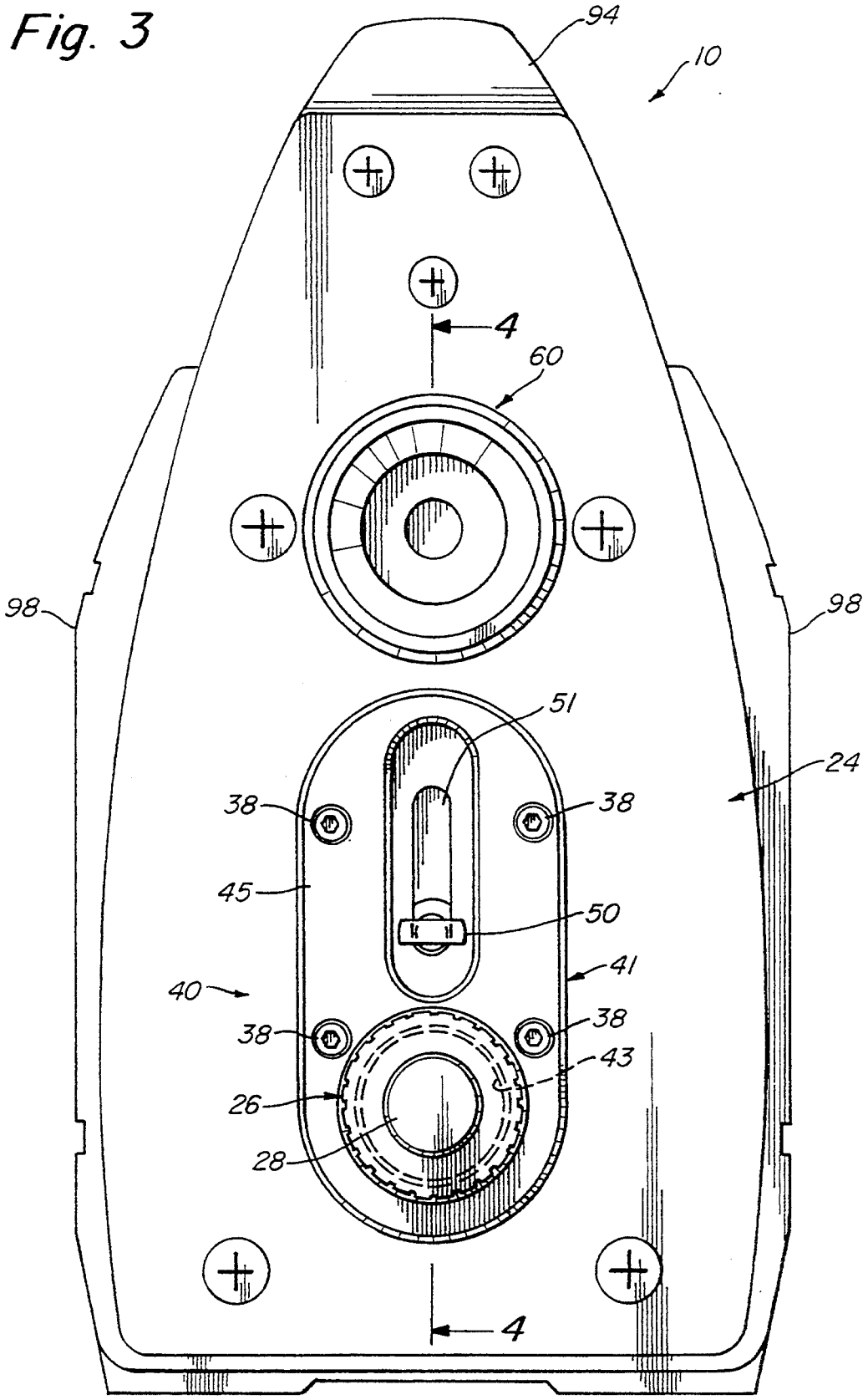

The camera is described with reference to the figures, and particularly FIG. 1. Radiographic camera 10 has a housing 12 which encloses a radiographic source 14 within a radiation shield 16. Source 14 is connected to one end of a source cable 18, and the other end of the source cable is connected to lock mechanism 20 at the back end 22 of the camera. The lock mechanism is generally similar to the lock mechanism described in U.S. Pat. No. 5,065,033, with differences which will be discussed below. Source 14 and source cable 18 are enclosed within an S-shaped tube 23 which extends from the lock mechanism to a connector assembly 40. The connector assembly has a guide 36 with an opening 34 into which the tube is connected. The guide is coupled to the front end 24 of the housing with screws 38 at openings 39 (FIG. 3).

Figure 1:
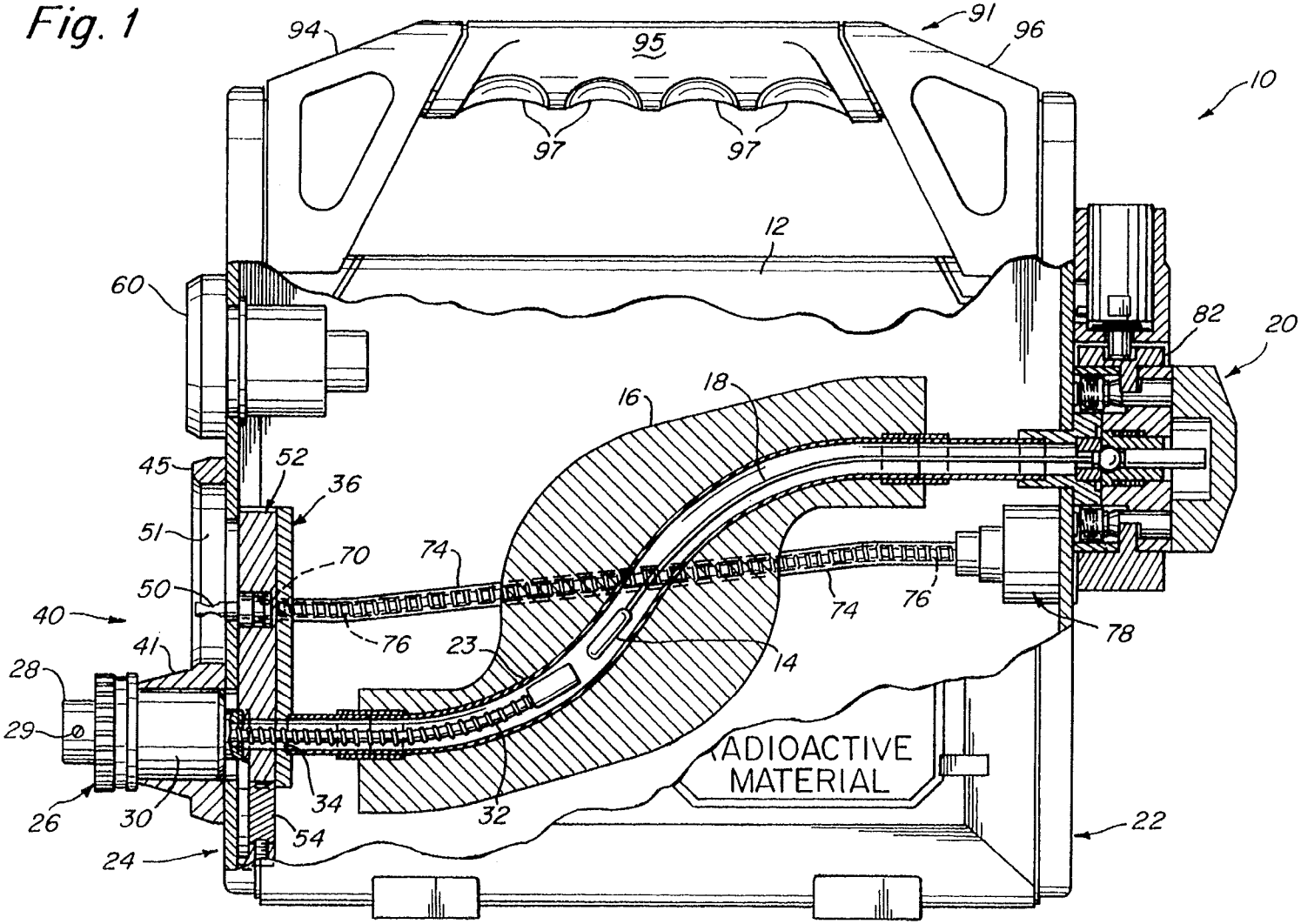
FIG. 1 is a partially cut-away cross-sectional side view of a radiographic camera according to the present invention.
Figure 2:
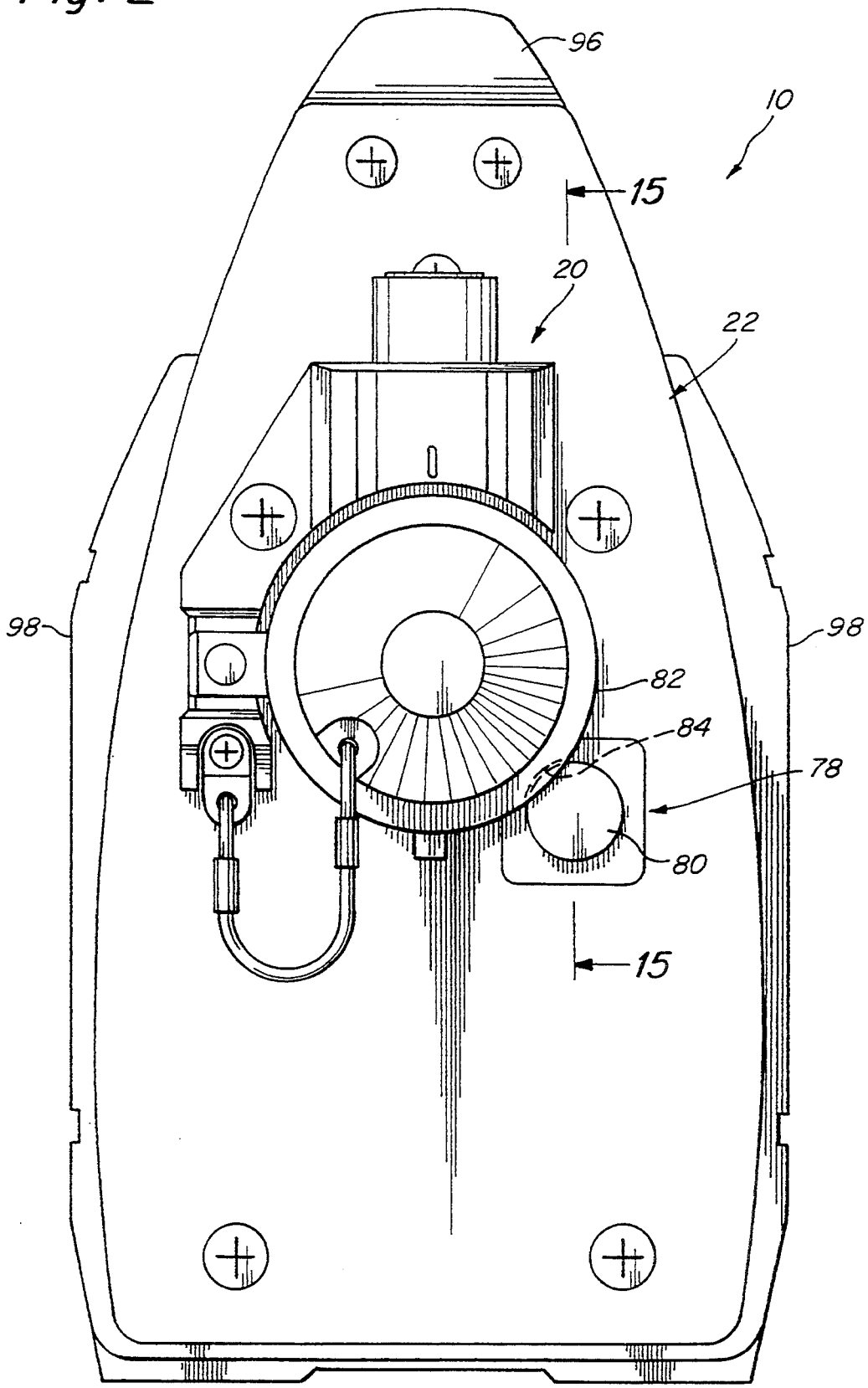
FIGS. 2 and 3 are end views of the back end and front end of the camera, respectively.

When in the stored position, as in FIG. 1, source 14 abuts or is adjacent a plug wire 32. The plug wire is part of plug assembly 26 that has a plug cap 28 and a plug fitting 30. The plug wire is coupled to the plug cap with a screw 29, and passes through a central opening in the fitting. Plug wire 32 helps to retain source 14 within the shield by minimizing the chance that the source can be dislodged during shipping. The plug assembly is mounted in the connection assembly 40 which is connected to the housing. At the internal end of fitting 30 are radially extending tabs 31 (FIG. 5) which interconnect with the connection assembly and allow selective removal.

As is generally known with other radiographic cameras control cables (not shown) are connected to lock mechanism 20, and a guide cable (FIGS. 6 and 14) is connected to front end 24. The control cable is coupled to source cable 18 for pushing source 14 out of housing 12 and into the guide tube. By using long control cables and a guide cable, a technician can set up the camera for taking images, and then push the radiation source out of the camera from a distance.

Figure 9:
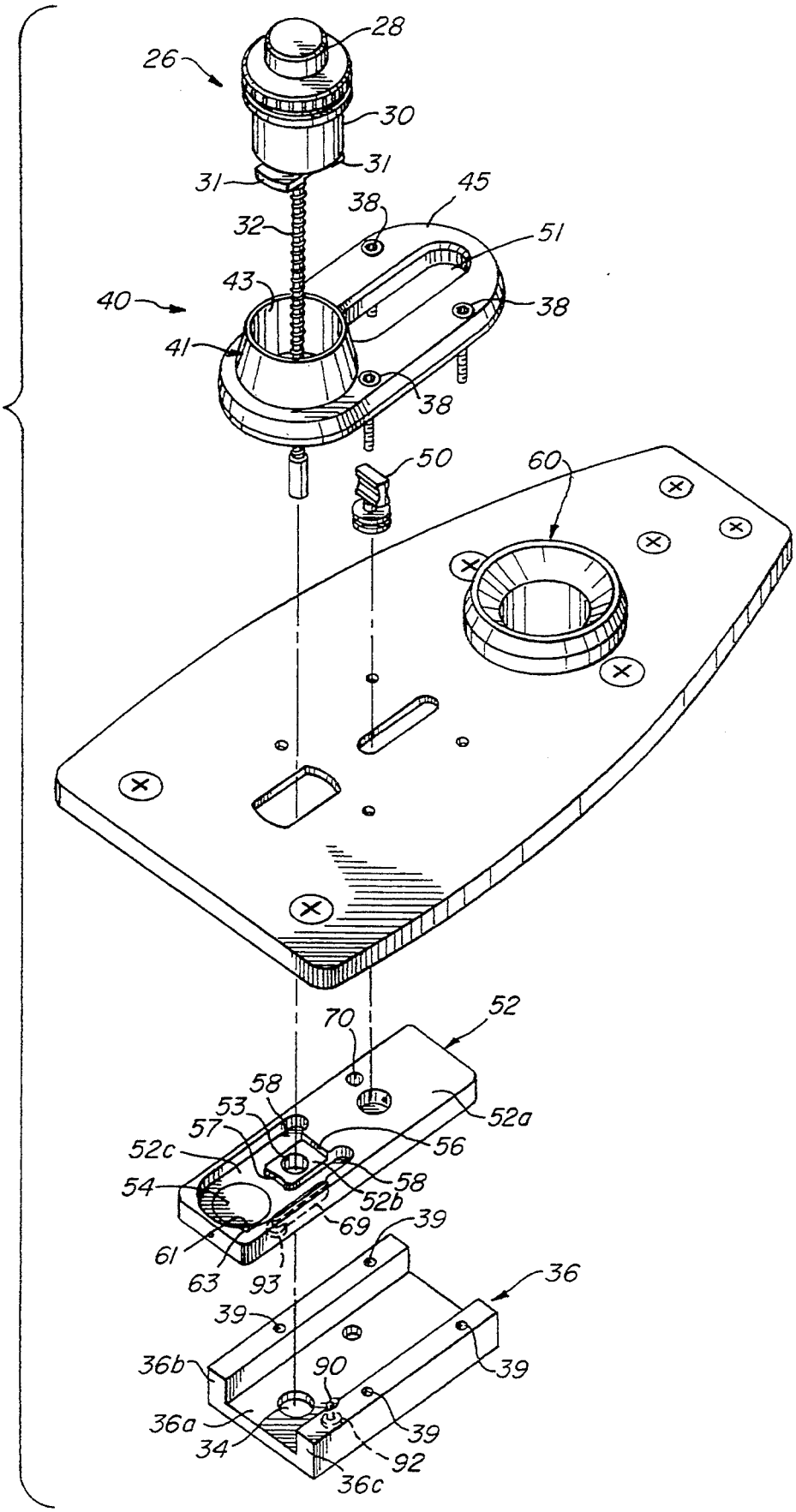
FIGS. 9 and 10 are exploded perspective views of the connection mechanism and fitting in two positions.
Figure 10:
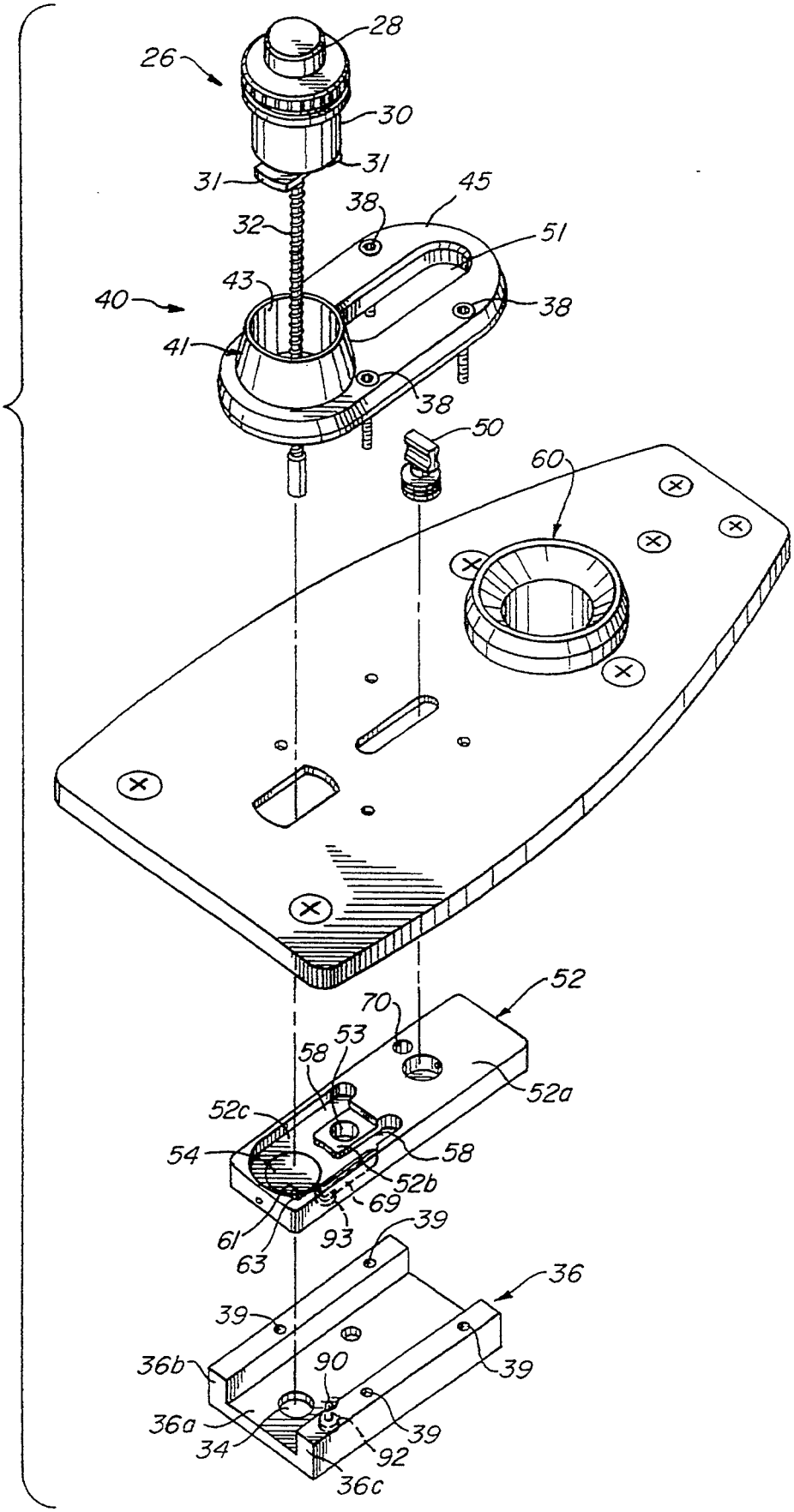

Referring to FIGS. 3–13, a shielding mechanism is provided to help prevent radiation from being emitted at front end 24 when a guide cable (FIG. 14) is to be connected to connector assembly 40. Assembly 40 has a metal adapter 41 mounted to the exterior of the housing with screws 38. Adapter 41 has a cylindrical opening 43 for receiving the guide cable or plug assembly, and a plate 45 which abuts the side of the housing. Guide 36 has a back wall 36*a* which is substantially parallel to plate 45, and guide rails 36*b*, 36*c* which have screw openings 39 (FIGS. 9 and 10). The back wall and the guide rails define a channel in which a linearly movable slide 52 is mounted. Slide 52 has an opening 53 and a tungsten shield 54 which is supported with a screw 55.

Figure 4:
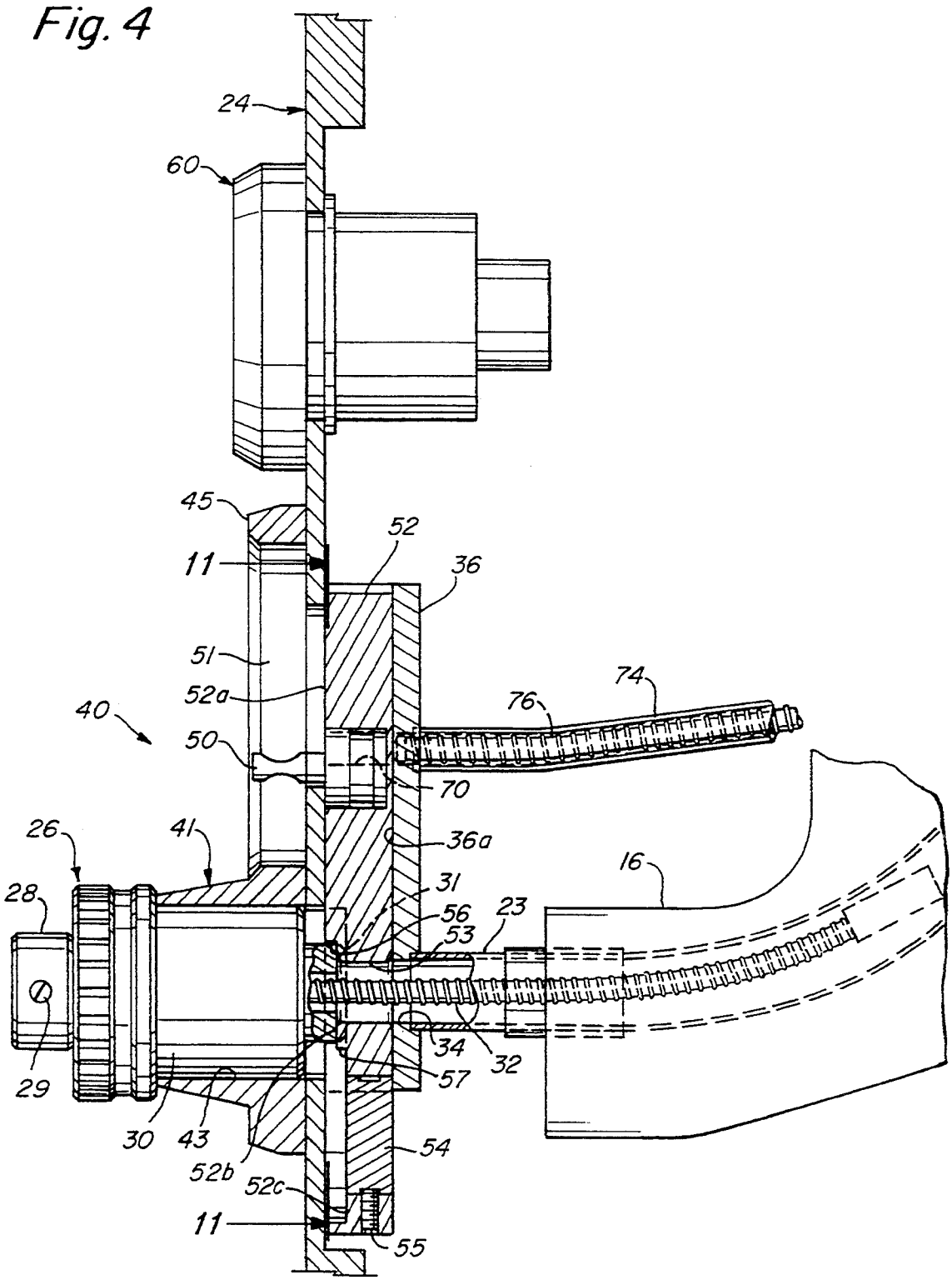
FIGS. 4–6 are partial close-up cross-sectional views of the front end of the camera illustrating three stages of operation.

The stages for removing plug assembly 26 and connecting the guide cable are discussed in connection with FIGS. 4–8 and 11. FIG. 4 illustrates the initial state when the source is in the stored position. In this position, the camera can be transported for use, and even shipped through commercial channels.

Figure 5:
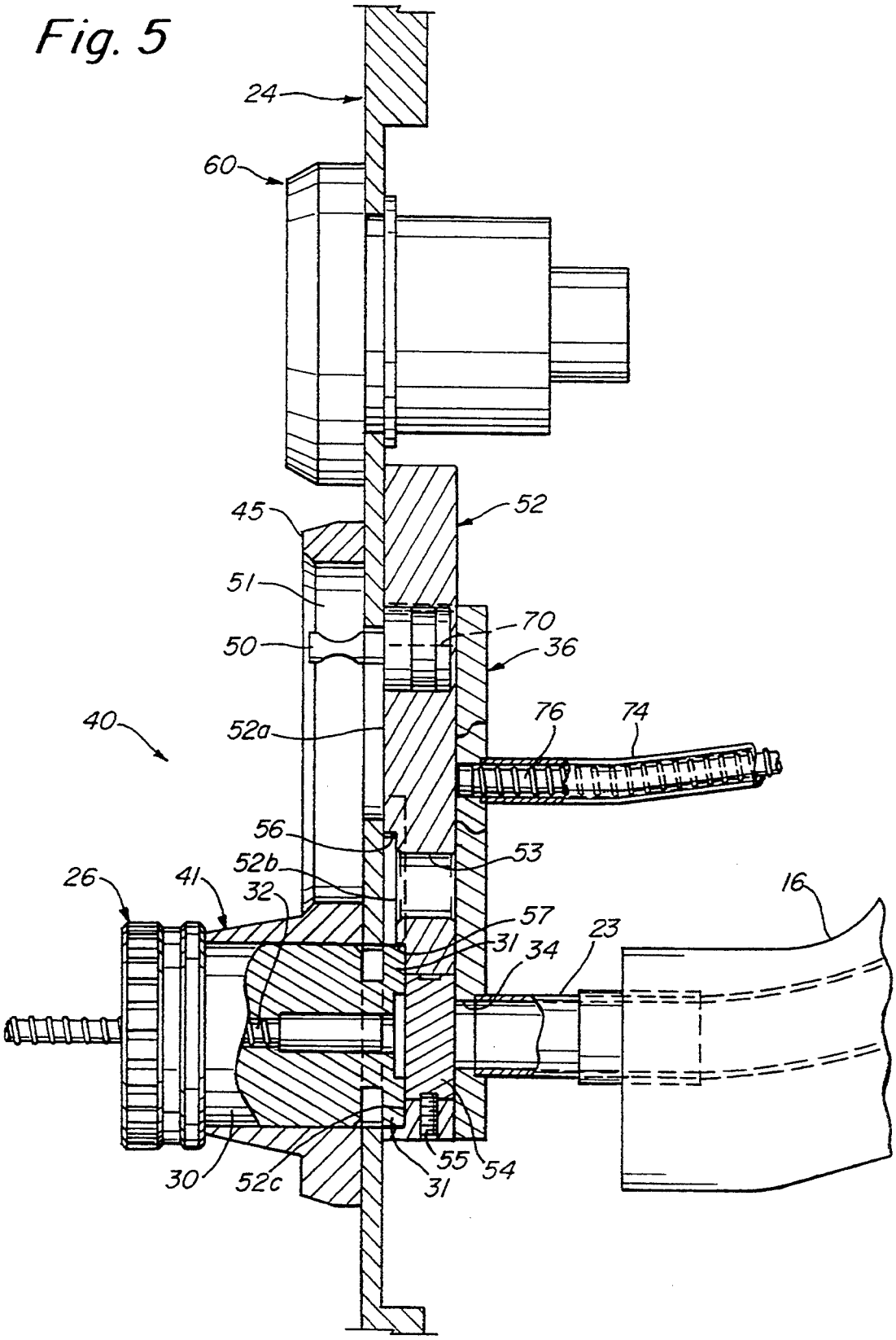
Figure 12:
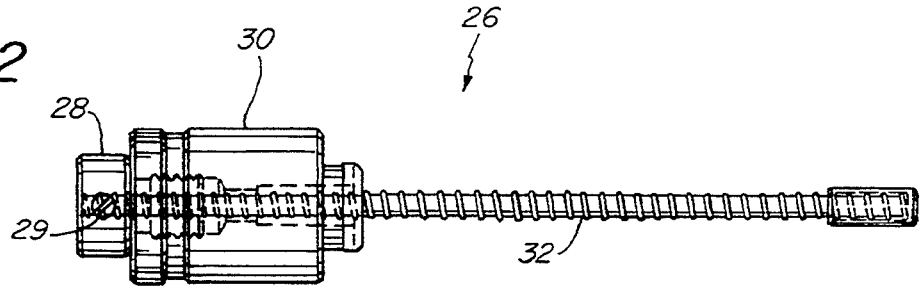
FIGS. 12 and 13 are side views partially in dashed lines of a plug assembly in two positions.
Figure 13:
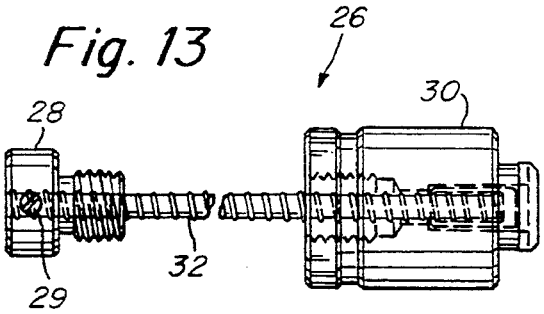

Referring also to FIGS. 5, 12, and 13, a technician unscrews threaded plug cap 28 from the fitting, and withdraws plug wire 32 from a first position in which the wire extends into the tube 23 in the housing (FIG. 4), to a second position in which the end of the wire is withdrawn from the housing and is inside fitting 30 (FIG. 5). When wire 32 is drawn out of fitting 30, the technician can raise slide handle 50 from a first lower position (FIG. 4) to a second upper position (FIG. 5). Slide handle 50 is mounted within a channel 51 and is connected to the slide. When the slide is in the first lower position (FIGS. 4, 8, and 9), opening 53 in the slide is aligned with tube 23. In the second upper position (FIGS. 5, 7, and 10), shield 54 is aligned with tube 23 and opening 34 in the guide so that it is intermediate the plug assembly and the source. The shield thus blocks the opening to the interior of the housing and helps prevent radiation from being emitted from the source to the exterior of the housing.

Slide 52 has portions 52*a*, 52*b*, 52*c* with differing thicknesses. The thickest portion, 52*a*, is about as wide as the gap between back wall 36*a* and the housing. Middle portion 52*b* has reduced thickness relative to portion 52*a* and located around opening 53. Further reduced thickness portion 52*c* is surrounds shield 54 and has legs 58 which extend vertically on either side of portion 52*b*.

When slide handle 50 is raised from the first position to the second position, shoulder portions 56, 57 (which are at the transitions between portions 52*a*, 52*b* and portions 52*b*, 52*c*) are raised. The radial tabs 31 of fitting 30 extend into the leg portions 58 of the guide. Since portion 52*a* is immediately above leg portions 58, when the slide is in the lower position, the fitting cannot be rotated and cannot be removed because of a lip in the slide. When the slide is raised to the upper position, however, the fitting at the inside faces only portion 52*c*, and thus can be rotated (Note the slight curve at shoulder 57 in FIG. 11). The technician can thus rotate fitting 30 counter-clockwise 90°, and then remove plug assembly 26. The fitting is limited from clockwise movement and from further counter-clockwise movement by a stop pin 61 located at a portion 63 of slide 52. After plug assembly 26 is rotated, it can be removed and inserted into a storage tube 60 which helps prevent the plug assembly from being misplaced.

Figure 11:
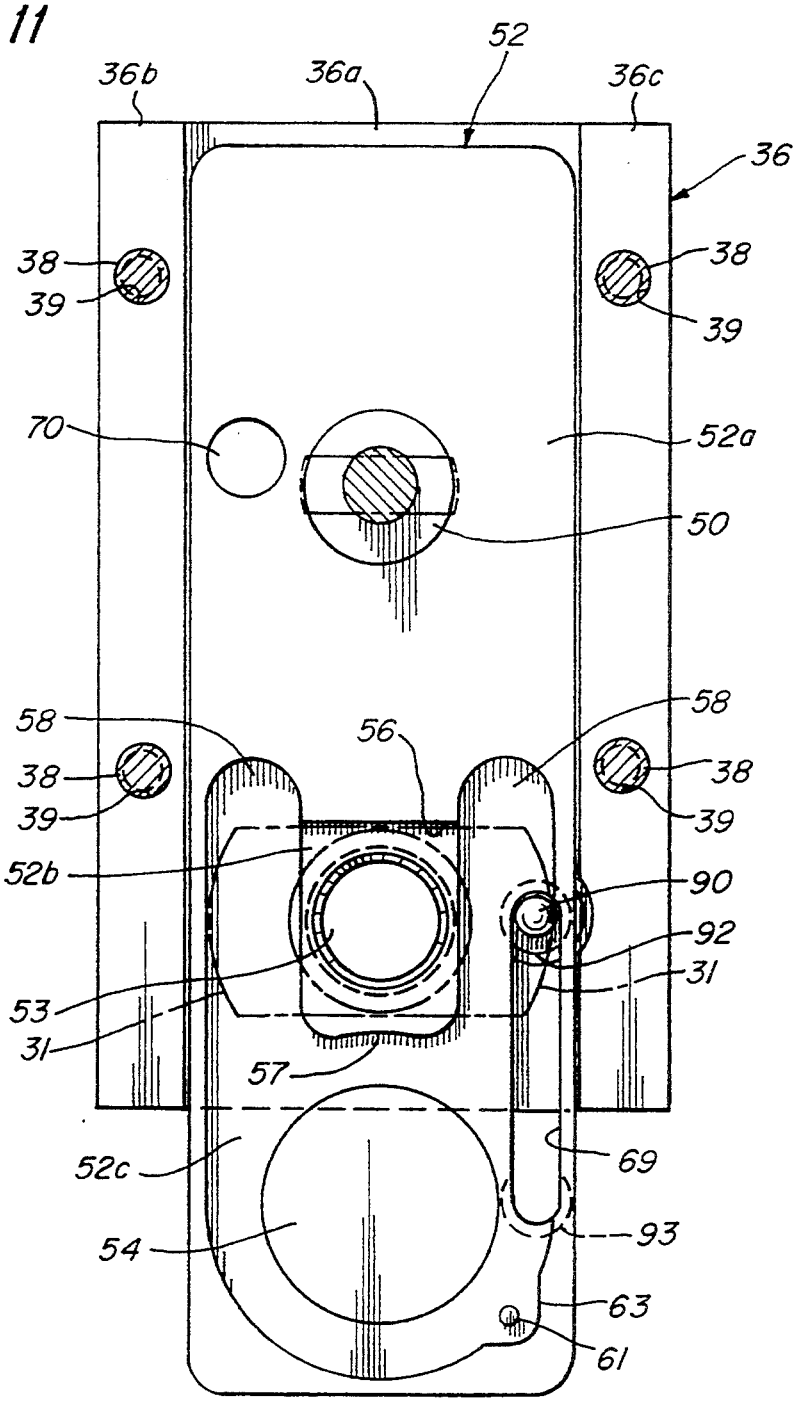
FIG. 11 is a view taken along the line 11—11 in FIG. 4.
Figure 17:
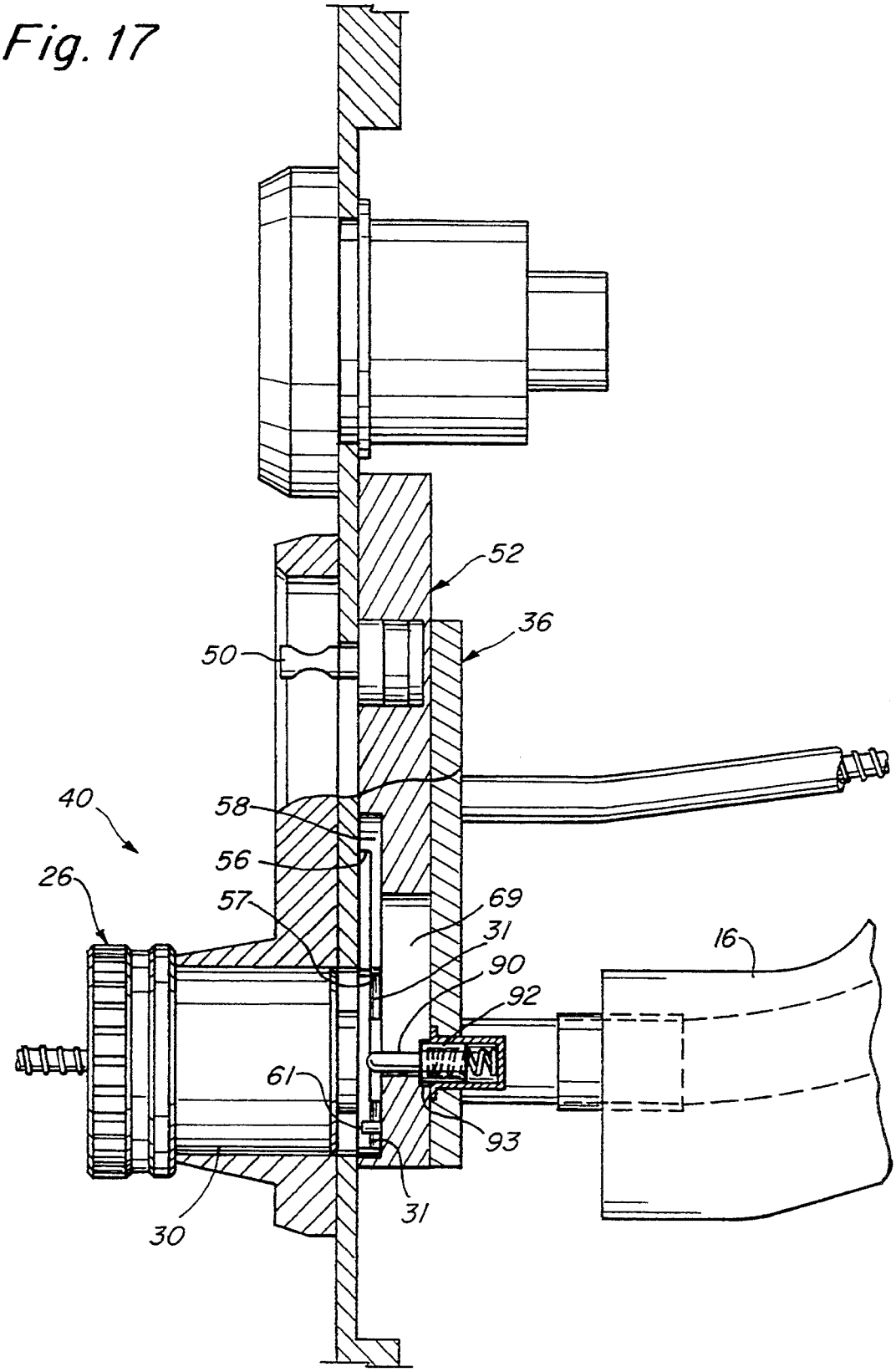
FIGS. 17 and 18 are partial cross-sectional side views at the front end including the locking pin.
Figure 18:
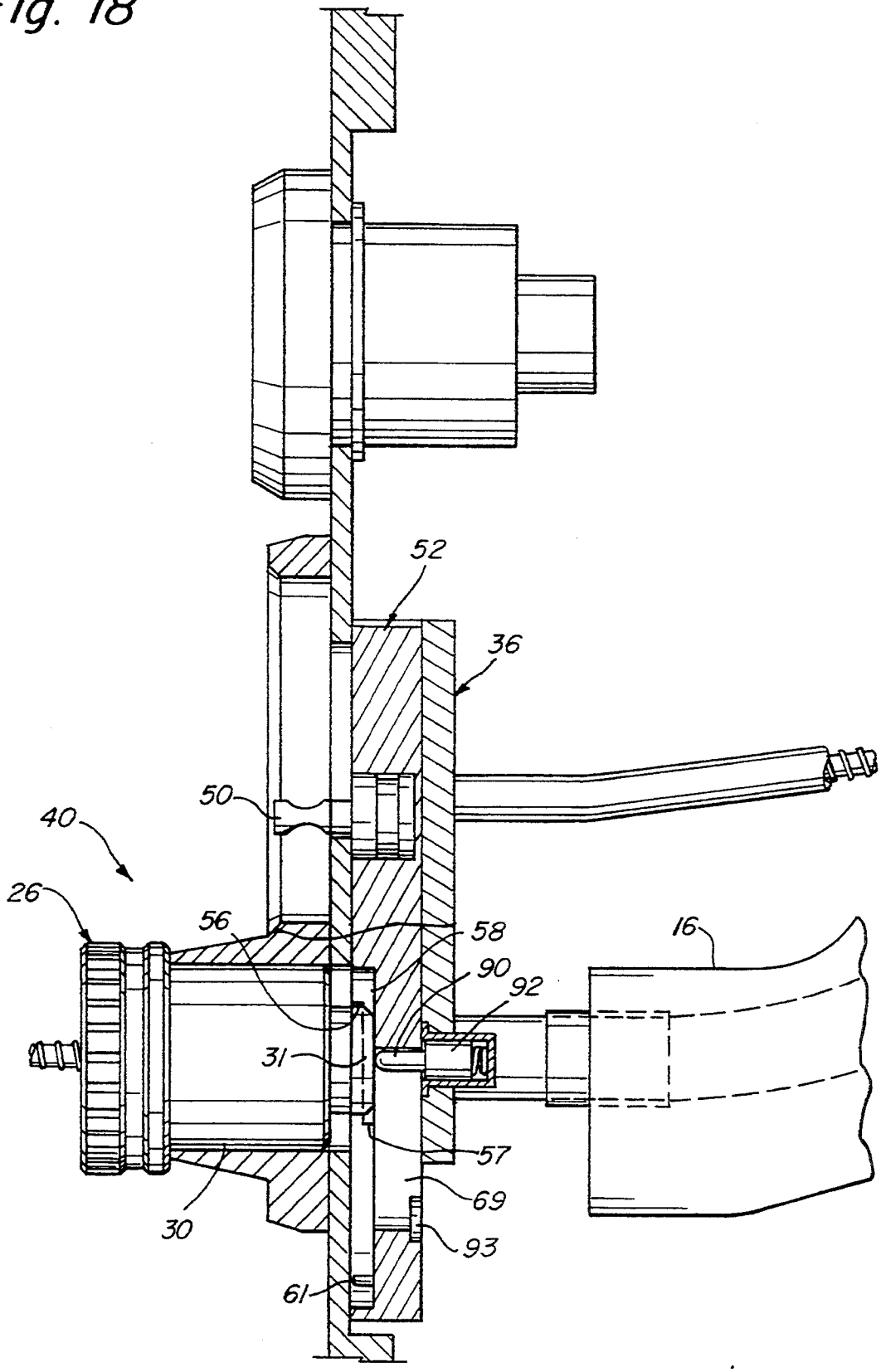

Referring also to FIG. 17, when the plug assembly is removed, the shield cannot be inadvertently lowered. As shown in FIGS. 17 and 18, a pin 90 is coupled to a spring mounted stop 92. Stop 92 is mounted to guide 36 and pin 90 extends through an opening in the slide. (FIGS. 17 and 18 generally correspond to FIGS. 5 and 6 although are not precisely taken along the same lines horizontally displaced from the shield.) When the pin is in its fully extended position, as shown in FIG. 17, the stop extends into a recess 93 in the back of slide 52 (shown in dashed lines in FIG. 11), thus preventing the slide from being moved downward. This occurs when radial tabs 31 are vertically oriented. When the plug assembly or the guide cable are positioned within opening 43 and are turned so that tabs 31 are horizontally oriented, one of the tabs presses down on the pin, thus pushing stop 92 away from the recess in slide 52, thus allowing the slide to be moved downward. As shown in FIG. 11, 17 and 18, pin 90 can move within slot 69.

Figure 6:
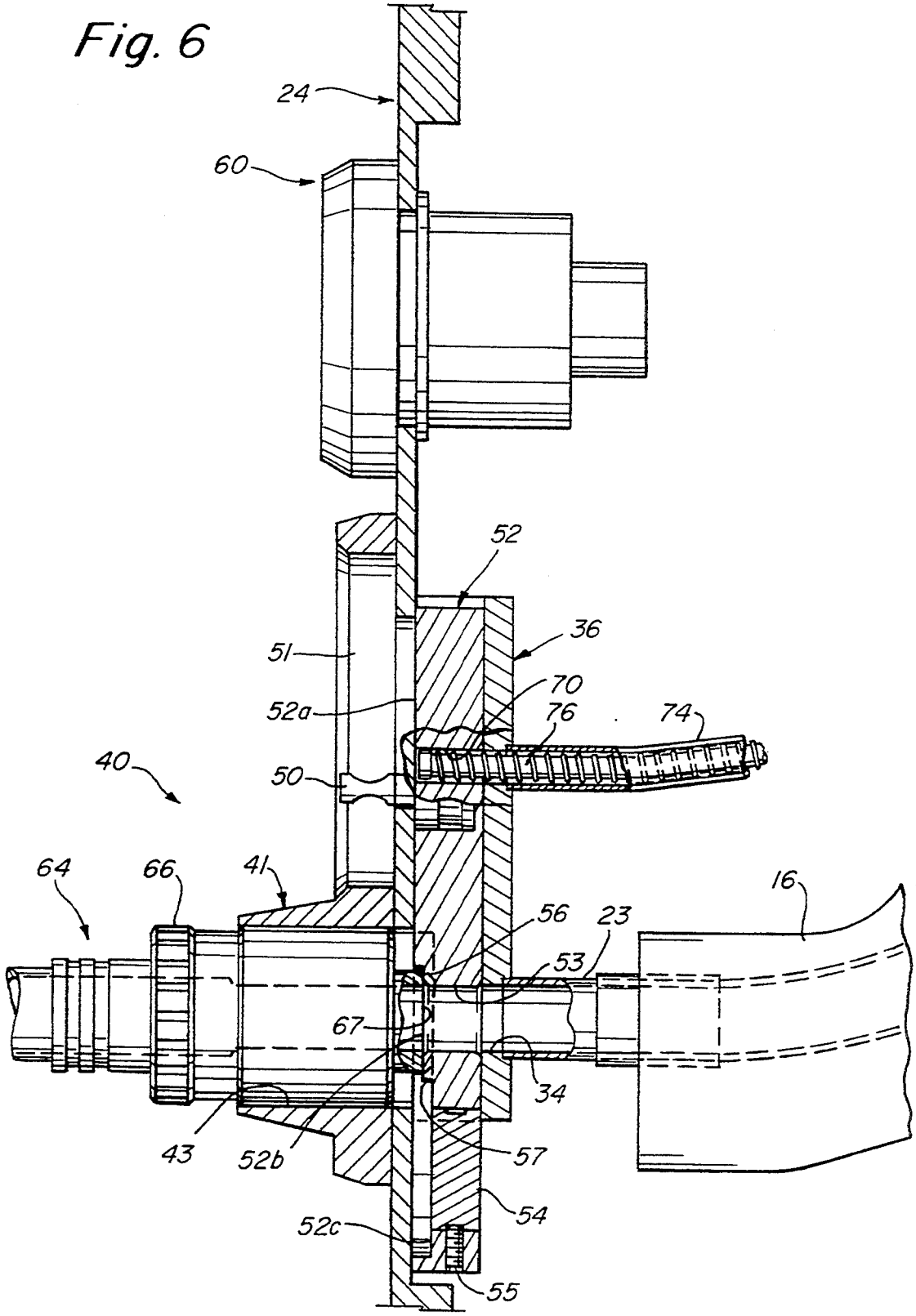
Figure 7:
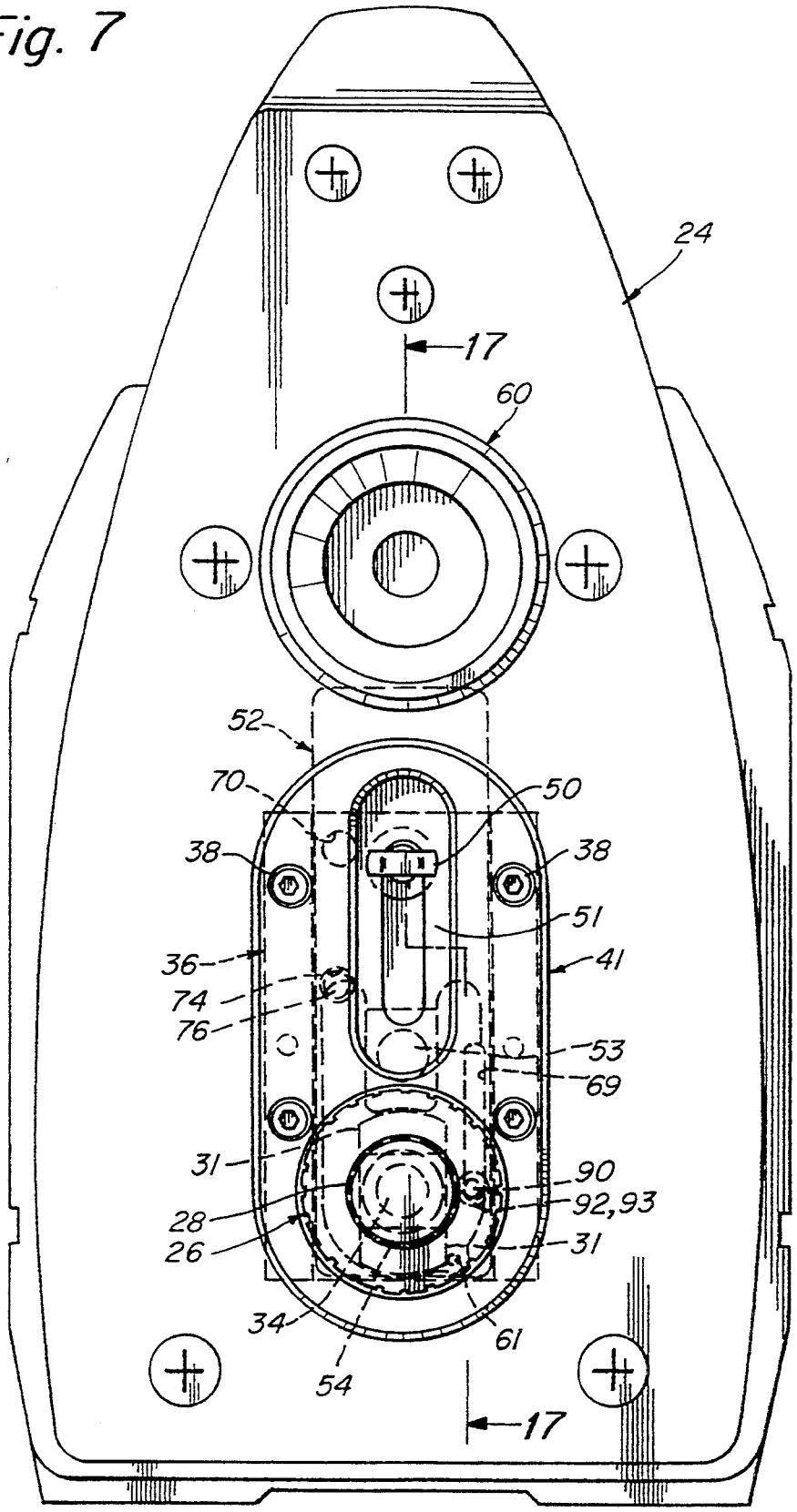
FIGS. 7 and 8 are end views of the back end when the shield is raised and lowered, respectively.
Figure 8:
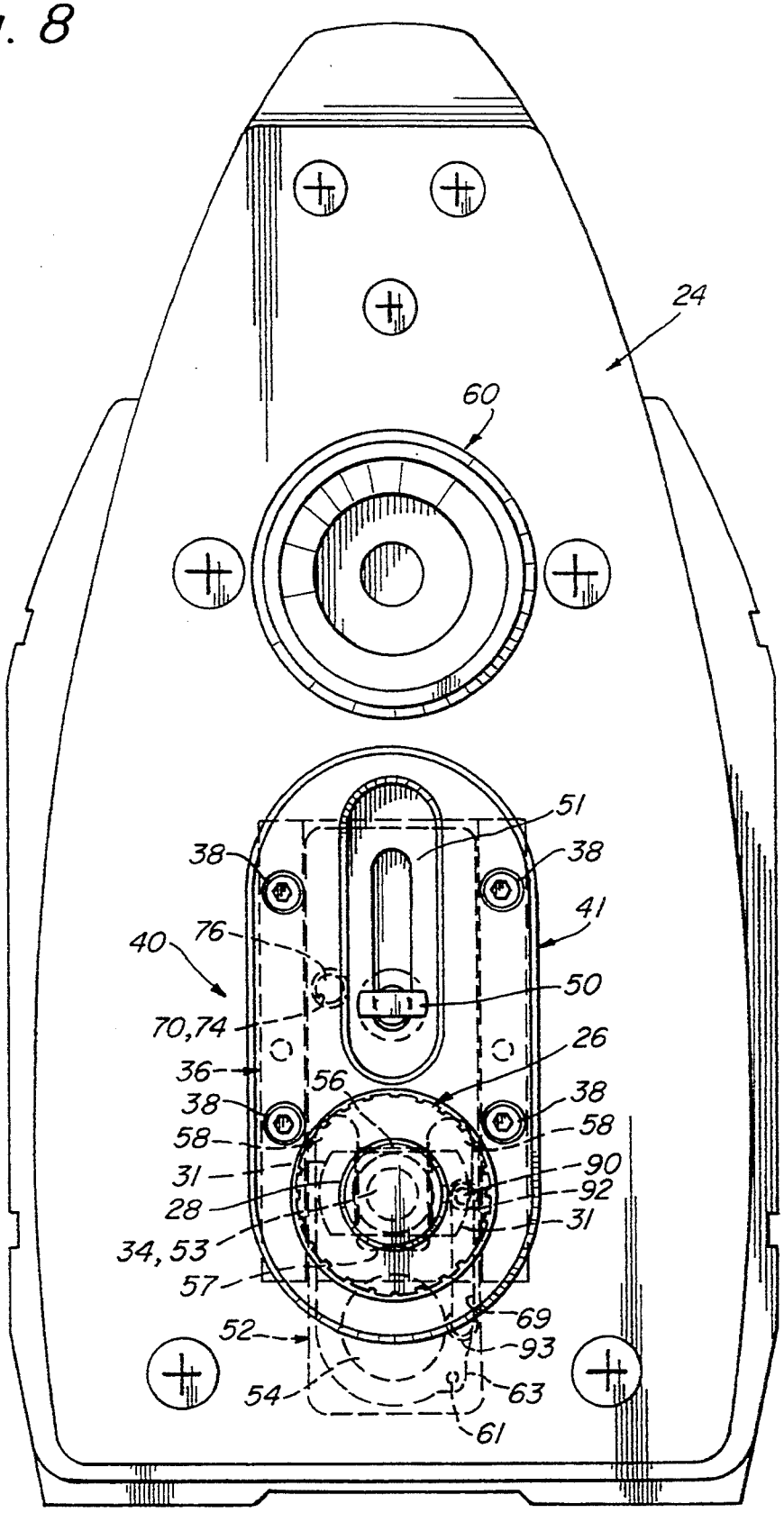
Figure 14:
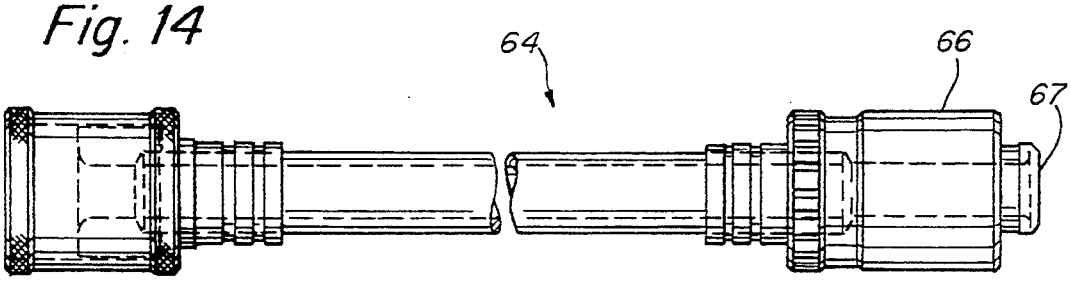
FIG. 14 is a side view of a guide cable.
Figure 15:
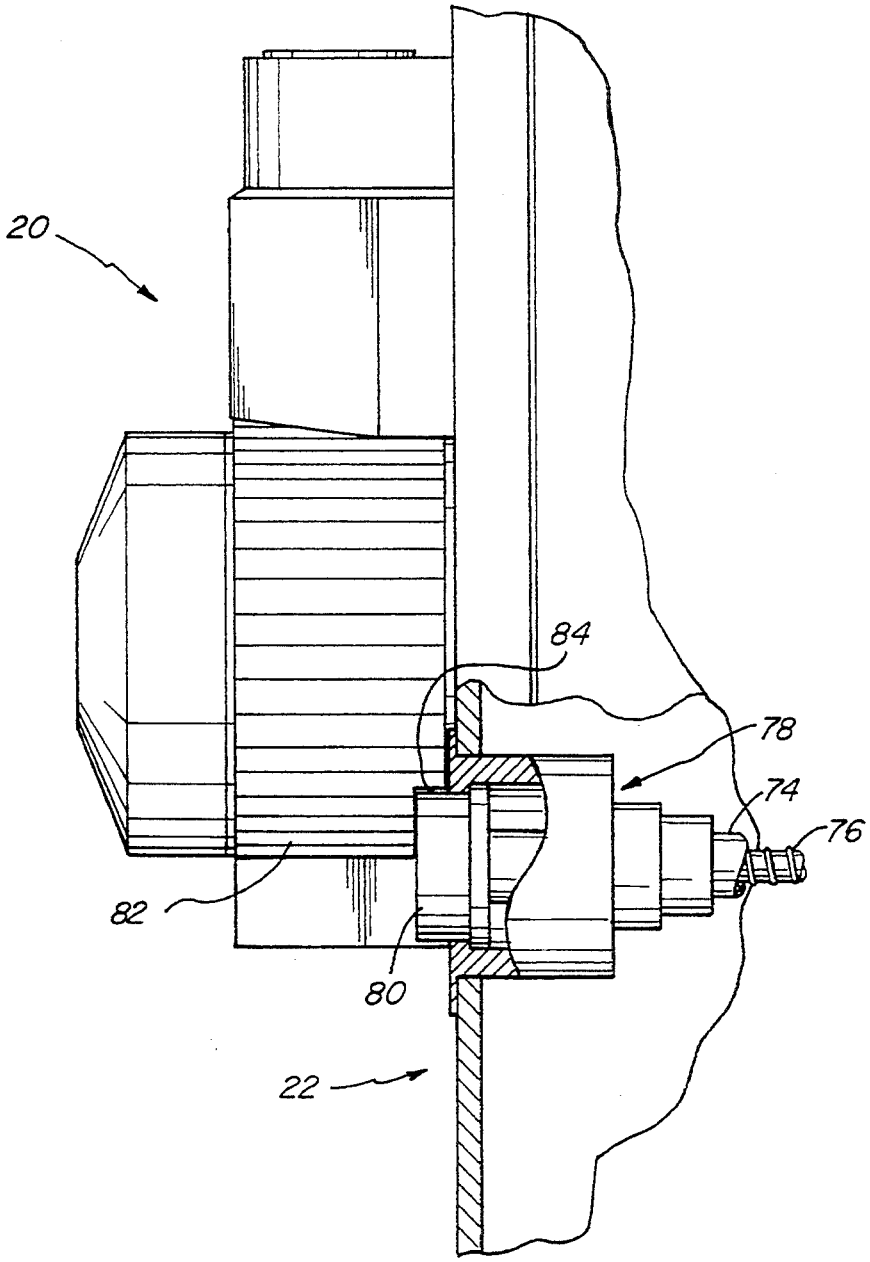
FIG. 15 is a partial cross-sectional side view of the back end of the camera.

Referring to FIGS. 6 and 14, after the plug assembly is removed, guide cable 64 has a fitting 66 that can be coupled into connector assembly 40. Fitting 66 has an end 67 which is similar to that of plug fitting 30. After the connector assembly is attached and rotated so that pin 90 pushes stop 92 away from the slide, the slide can be lowered again to the first position, as shown in FIGS. 6 and 18. The source is thus unblocked at the front end.

Operation of slide handle 50 has yet another effect. Slide 52 has an opening 70 which is adjacent the connection to handle 50 and which is aligned with tube 74 when the slide is in the first lower position. This tube encloses a cable 76. As also shown in FIG. 1, tube 74 and cable 76 extend from the back end 20, next to the lock mechanism 22, to the front end 24. At back end 20, cable 16 extends into a button assembly 78 which has a switch 80 shown here as a push button. Since the end of tube 74 is blocked when the slide is in the upper position, as shown in FIG. 5, the button cannot be pushed.

Figure 16:
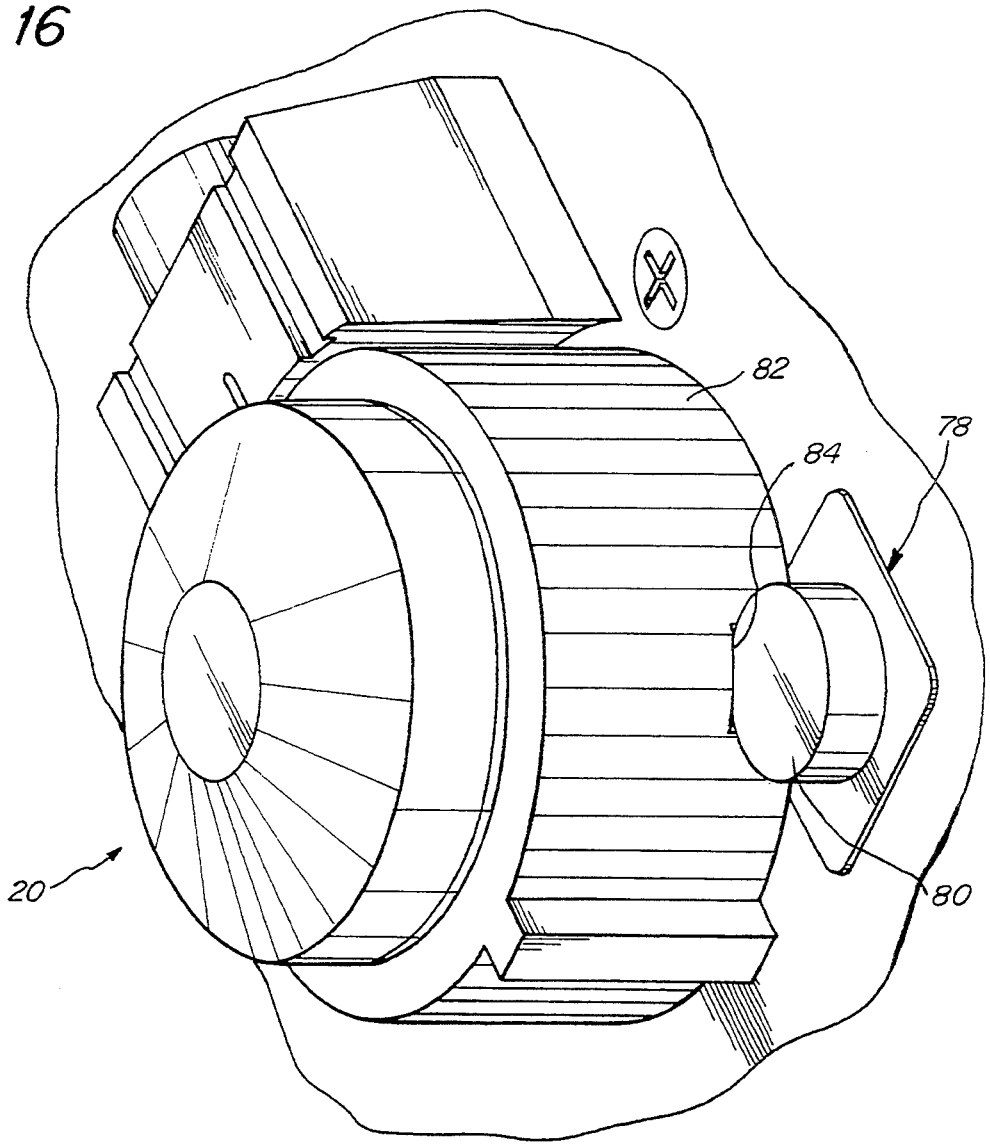
FIG. 16 is a perspective view of the lock assembly of FIG. 15.

Referring to FIG. 16, lock assembly 20 has a disk 82 which must be rotated to a "connect" position to allow control cables (not shown) to be attached. (This mechanism is described in more detail in the incorporated U.S. Pat. No. 5,065,033) Button 80 extends into a recessed portion 84 in disk 82 to physically prevent the disk from being rotated. Unless button 80 is pushed, the disk cannot be turned and the control cables cannot be connected. Thus assembly 78 and button 80 serve as a disabling mechanism for the lock assembly, depending on the position of the shield.

When the shield is down in the initial position (FIG. 4) the button can be pushed, but then the shield could not be moved. A spring (not shown) in assembly 78 urges the button away from the housing. When the disk is rotated to align the button with the recessed portion, the button pops back out.

Figure 19:
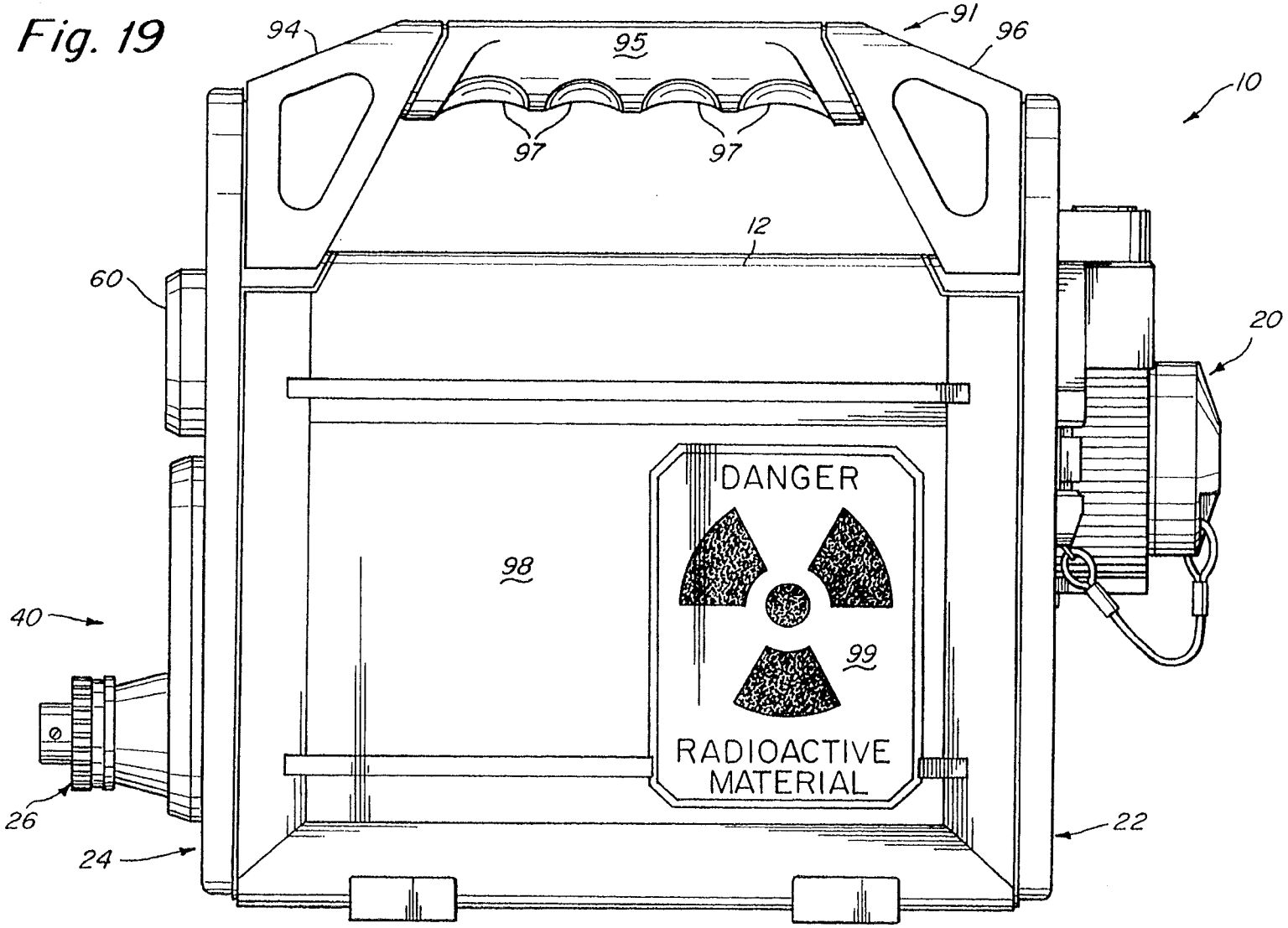
FIG. 19 is a side view of a camera according to the present invention.

Referring to FIG. 19, the housing has a handle 91 which has a gripping portion 95 with finger channels 97, and angled metal brackets 94, 96. The gripping portion is colored black, as is most of the housing, while the brackets are stainless steel. The sides have rubber panels 98 to help protect the camera. A yellow colored warning label 99 with a legend is also provided on the side.

In the method of operating the camera according to the present invention, a technician removes the plug wire portion of the plug assembly from the interior of the housing. The technician shields the opening at the front end of the housing and removes the plug assembly from the camera. The guide cable is attached to the front end, and the shield is moved to unblock the opening. The technician then operates a switch which enables the locking mechanism at the back end of the housing so that it can be accessed to connect control cables. The end of the guide cable can be positioned next to an object, such as a metal pipe, and the technician can operate the control cables to push the radiographic source to the end of the guide cable. Images can then be taken to detect flaws in the pipe.

Having described an embodiment of the present invention, it should become apparent to those skilled in the art that changes and modifications may be made without departing from the scope of the appended claims. For example, a movable body, such as a rotatable disk, can be provided at the front end of the camera. The guide cable is connected to one portion of the disk while another portion of the disk shields the opening. Only after the guide cable is attached to the disk can the disk be rotated so that the guide cable is aligned with the opening. The disk also shields the opening while it is being rotated.

It should be understood that the opening in the front generally refers to the between the source and the exterior of the housing. The shield could also be mounted outside of the walls of the housing, or a wall could have a movable shield between layers, in a manner somewhat analogous to the present invention.

It should also be noted that each figure is generally drawn to scale with respect to other parts within the same figure, but that different figures may have different overall scale.

What is claimed is:

1. A radiographic camera apparatus for use with a control cable and a guide cable, the apparatus comprising:

a housing enclosing an interior chamber from the exterior of the housing, the housing having a first opening and a second opening;

a locking assembly coupled to the housing at the first opening for receiving the control cable;

a connector assembly coupled to the housing at the second opening;

a removable plug assembly, the connector assembly for receiving one of the plug assembly and the guide cable; and a curved inner conduit within the housing and coupled to the locking assembly at one end and to the connector assembly at the other, a pathway being formed from the inner conduit to the exterior of the housing through the connector assembly;

the connector assembly having a shield mechanism including a shield, wherein the mechanism is movable from a first position in which the shield blocks the pathway to a second position in which the shield does not block the pathway.

2. The apparatus of claim 1 wherein the shield mechanism includes a slide and the shield is mounted within the slide, the slide having an opening which is intermediate the inner conduit and one of the plug assembly and the guide cable when the shield mechanism is in the second position.

3. The apparatus of claim 2 further comprising a spring loaded locking pin for preventing the slide from movement relative to the housing when the shield mechanism is in the first position.

4. The apparatus of claim 1 wherein the shield mechanism includes a manually actuable handle.

5. The apparatus of claim 4 wherein the handle is disabled when neither the plug assembly nor the guide cable is connected to the adapter.

6. The apparatus of claim 1 further comprising a switch coupled to the locking assembly for enabling the locking assembly to receive a control cable, wherein the shield mechanism includes a support body for the shield, the support body being coupled to the switch so that the position of the support body determines whether the switch is actuable.

7. The apparatus of claim 6 wherein the switch is actuable when the shield mechanism is in the second position, and the switch is not actuable when the shield mechanism is in the first position.

8. The apparatus of claim 1 wherein the connector assembly has a guide having walls which define a channel, wherein the guide is rigidly connected to the housing and is rigidly connected to the inner conduit, and wherein the shield mechanism includes a body which moves within the channel and intermediate the guide and the housing.

9. The apparatus of claim 1, wherein the plug assembly includes a plug wire for extending into the conduit when the camera is in a stored position;

a plug cap coupled to the plug wire;

a plug fitting for coupling with the connector assembly, the plug fitting having an opening through which the plug wire extends, wherein the plug wire is movable from a first position in which the wire extends into the conduit to a second position in which the plug wire does not extend into the conduit, the wire being movable from the first position to the second position while the plug fitting is coupled to the connector assembly without removing the plug fitting.

10. The apparatus of claim 1, further comprising means interconnecting the plug assembly and the shield mechanism for restricting movement of the plug assembly relative to the shield mechanism so that when the plug assembly is in a first position the shield mechanism is movable, and when the plug assembly is in a second position the shield mechanism is fixed relative to the plug assembly.

11. An apparatus comprising:

a housing having a back end with a first opening and a front end with a second opening;

a tube inside the housing extending from the front end to the back end, and communicable with the first opening and the second opening;

a source cable within the source tube;

a radiographic source coupled to an end of the source cable;

an adapter coupled to the housing at the second opening for receiving a guide cable, the adapter having a body which is movable relative to the housing;

a lock mechanism coupled to the housing at the first opening and coupled to another end of the source cable, the lock mechanism for receiving a control cable; and a switch mechanism coupled to the adapter and to the lock mechanism, the switch being actuable in response to the movable body for selectively activating and deactivating the lock mechanism, wherein the control cable cannot be connected to the lock mechanism without actuating the switch.

12. The apparatus of claim 11 wherein the switch mechanism includes a push button.

13. The apparatus of claim 11 wherein the lock mechanism has a disk which requires rotational movement to insert the control cable, wherein the switch mechanism prevents the disk from being moved unless the switch mechanism is actuated.

14. The apparatus of claim 11, wherein the switch mechanism includes a cable coupled to the adapter, wherein movement of the cable relative to the back end is physically blocked by the adapter when the adapter is in a first position, and wherein movement is allowed when the adapter is in a second position.

15. The apparatus of claim 14, wherein the adapter includes a shield for blocking the second opening, wherein in the first position the shield blocks the opening, and in the second position the shield does not block the opening.

16. The apparatus of claim 11, wherein the tube is S-shaped.

17. In a radiographic camera having a housing, a first mechanism for receiving a control cable, and an adapter for receiving a guide cable, the camera having a radiographic source connected to a source wire which is within a conduit extending from the first mechanism to the adapter, wherein the source is sealed from the outside of the housing in a stored position by a plug assembly in a receptacle in the adapter, and wherein in a operative position, the control cable is connected to the source wire to cause the source to be pushed out of the housing and into the guide cable, the adapter comprising:

a shield mechanism including a shield portion, wherein the shield mechanism is movable from a first position in which the shield is intermediate the receptacle and the conduit, and a second position in which the shield is not intermediate the receptacle and the conduit; and a mechanism for moving the shield between the first position and the second position.

18. The adapter of claim 17, wherein the mechanism includes a manually actuable handle.

19. The adapter of claim 17, further including a guide having rails for guiding the shield mechanism, wherein the shield mechanism moves within the guide.

20. The adapter of claim 17, further comprising means interconnecting the plug assembly and the shield mechanism for restricting movement of the plug assembly relative to the shield mechanism so that when the plug assembly is in a first position the shield mechanism is movable, and when the plug assembly is in a second position the shield mechanism is fixed relative to the plug assembly.

21. In a radiographic camera having a housing, a first mechanism for receiving a control cable, and an adapter for receiving a guide cable, the camera having a radiographic source connected to a source wire which is within a conduit extending from the first mechanism to the adapter, wherein the source is sealed from the outside of the housing in a stored position by a plug assembly removably connected to a receptacle in the adapter, and wherein in a operative position, the control cable causes the source to be pushed out of the housing and into the guide cable, the plug assembly comprising:

a plug wire for extending into the conduit when the camera is in a stored position;

a plug cap coupled to the plug wire;

a plug fitting for coupling with the receptacle, the plug fitting having an opening through which the plug wire extends, wherein the plug wire is movable from a first position in which the wire extends into the conduit to a second position in which the plug wire does not extend into the conduit, the wire being movable from the first position to the second position while the plug fitting is coupled to the receptacle without removing the plug fitting.

22. In a radiographic camera having a housing, a first mechanism for receiving a control cable, and an adapter for receiving a guide cable, the camera having a radiographic source connected to a source wire which is within a conduit extending from the first mechanism to the adapter, the adapter having a movable mechanism for determining whether the guide cable can be received, wherein the source is sealed from the outside of the housing in a stored position by a plug assembly coupled to the adapter, and wherein in a operative position, the control cable causes the source to be pushed out of the housing and into the guide cable, the first mechanism comprising:

a receptacle for receiving the control cable;

a movable body movable from a first position in which the control cable can be attached to the receptacle, to a second position in which the control cable cannot be connected to the receptacle;

a switch mechanism for allowing the movable body to be moved from the first position to the second position, the switch mechanism being coupled to the adapter and responsive to the movable mechanism of the adapter for actuation, the switch being actuable when the movable mechanism is in one position, and not actuable when the movable mechanism is in another position.

23. The mechanism of claim 22, wherein the movable body includes a dial.

24. The mechanism of claim 22, wherein the switch mechanism includes a cable extending to the adapter.

25. The mechanism of claim 22, wherein the switch mechanism includes a push bottom that prevents movement of the movable body when the body is in the first position and the switch is not actuable.

26. A method for operating a radiographic camera having a housing, the housing enclosing a radiographic source in a tubular conduit, with a front end with an opening and a back end with an opening, the camera further having a first adapter coupled to the back end for receiving a control cable, and a second adapter coupled to the front end for receiving a guide cable, a plug assembly being coupled to the second adapter, the plug assembly blocking the opening at the front end, the method comprising the steps of:

shielding the opening in the front end intermediate the source and the plug assembly;

removing the plug assembly from the second adapter;

coupling the guide cable to the second adapter; and moving the shield from a position intermediate the guide cable and the source to form a pathway for the source to enter the guide cable.

27. The method of claim 26, wherein the removing step is performed only after the shielding step.

28. The method of claim 27, wherein the coupling step is performed only after removing step.

29. The method of claim 27, further including a step of withdrawing a portion of the plug assembly away from the housing prior to the shielding step and the removing step.

30. The method of claim 26, wherein the step of shielding includes a step of manually moving a member mounted.

31. The method of claim 26, further including the steps of actuating a switch mechanism after the moving step, and coupling the control cable to the first adapter, wherein the coupling step can only be performed after the actuating step.

32. The method of claim 26, further including a step of actuating a switch mechanism before the shielding step, and coupling the control cable to the first adapter, wherein the coupling step can only be performed after the actuating step.

* * * * *